United States Patent [19]

Schulte et al.

[11] 4,186,057

[45] Jan. 29, 1980

[54] GAS EXTRACTING AND PURIFYING EQUIPMENT

[75] Inventors: Fritz Schulte, Meerbusch-Büderich; Johann G. Riecker, Ratingen, both of Fed. Rep. of Germany

[73] Assignee: Hartung, Kuhn & Co. Maschinenfabrik GmbH, Dusseldorf, Fed. Rep. of Germany

[21] Appl. No.: 764,215

[22] Filed: Jan. 31, 1977

[51] Int. Cl.[2] ..... C10B 33/00; C10B 39/14; C10B 45/00

[52] U.S. Cl. ..... 202/263; 202/227; 202/242; 202/254; 202/269

[58] Field of Search ..... 202/227, 242, 262, 263, 202/254, 257, 269

[56] References Cited

U.S. PATENT DOCUMENTS

| | | | |
|---|---|---|---|
| 3,647,636 | 3/1972 | Helm | 202/263 |
| 3,676,305 | 7/1972 | Cremer | 202/227 X |
| 3,715,282 | 2/1973 | Pries et al. | 202/227 X |
| 3,785,933 | 1/1974 | Edgar et al. | 202/227 X |
| 3,801,472 | 4/1974 | Kemmetmueller | 202/263 |
| 3,844,900 | 10/1974 | Schulte | 202/263 X |
| 3,970,526 | 7/1976 | Bender | 202/227 |
| 3,984,289 | 10/1976 | Sustarsic et al. | 202/262 |

FOREIGN PATENT DOCUMENTS

| | | | |
|---|---|---|---|
| 2038729 | 2/1972 | Fed. Rep. of Germany | 202/26.3 |
| 2141696 | 2/1973 | Fed. Rep. of Germany | 202/262 |

*Primary Examiner*—Michael S. Marcus
*Attorney, Agent, or Firm*—Dressler, Goldsmith, Clement, Gordon & Shore, Ltd.

[57] ABSTRACT

Equipment for receiving and transporting red-hot coke, pushed out of the oven chambers of a chamber coke-oven with vertical flue, and for extracting and purifying the dust-containing gases rising from the coke. The equipment includes duct means and associated suction means for initially extracting the dust-containing gases from an extractor hood and subsequently from the container collecting the hot coke.

6 Claims, 7 Drawing Figures

GAS EXTRACTING AND PURIFYING EQUIPMENT

Figure 1:
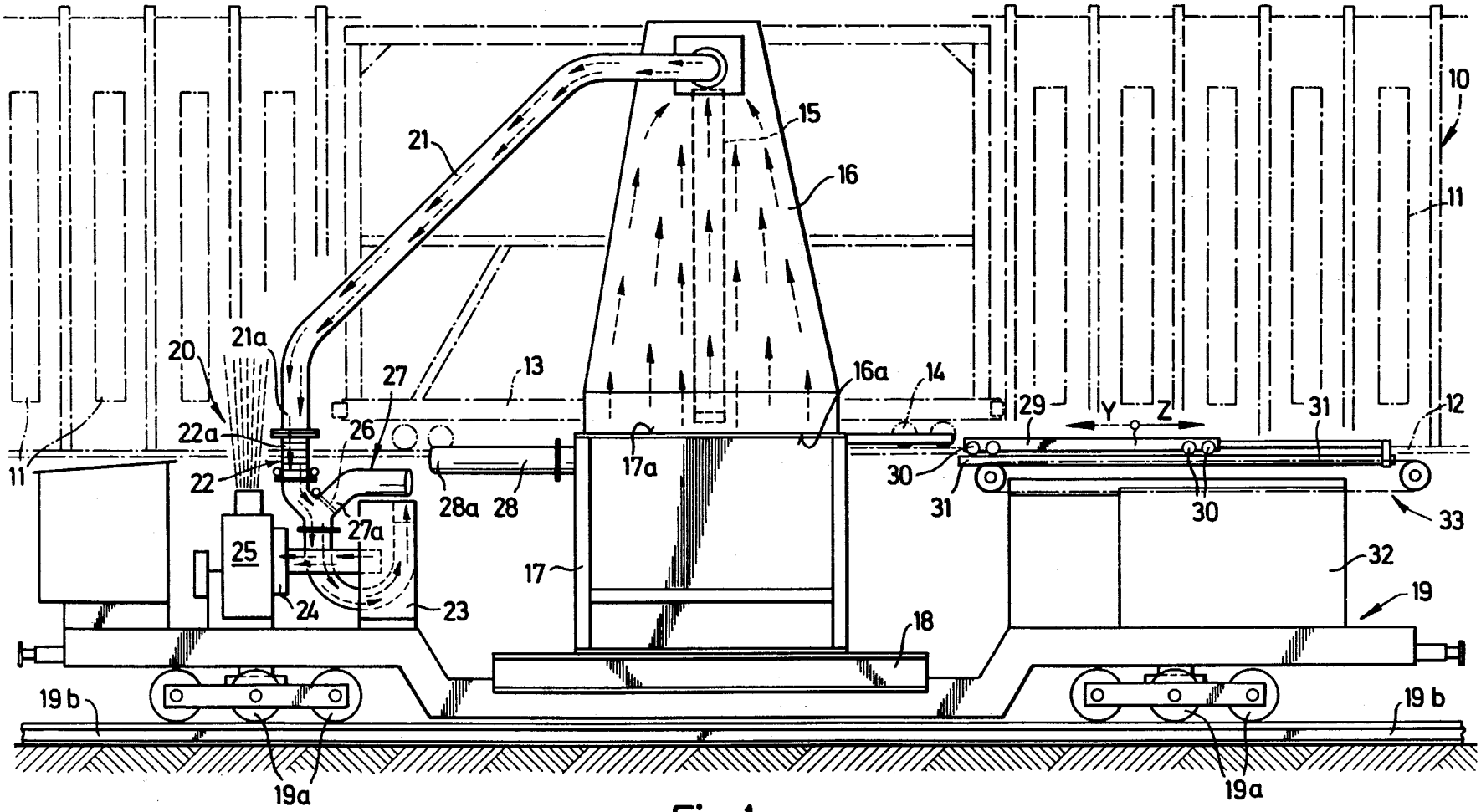

The invention relates to equipment for receiving and transporting red-hot coke, pushed out of the oven chamber of a chamber coke-oven with vertical flue, and for extracting and purifying the dust-containing gases rising from the coke.

It is known to arrange, on the gas gallery on the coke side of a chamber coke-oven with vertical flue, a coke batch-conveying truck which can be driven. The truck is provided with an extractor hood for the gases that are charged with dust and which rise from the red-hot coke when the latter is pushed out of an oven chamber and is moved through the coke batch guide of the coke batch-conveying truck, when the red-hot coke batch breaks apart on leaving the coke batch guide and when the red-hot coke impinges and is stored on a quenching base which, if appropriate, can be driven. As a rule, conventional quenching trucks which have a sloping floor and are open are used in equipment of this type. While a red-hot coke batch is pushed out of an oven chamber, the quenching truck is moved along under the extractor hood of the coke batch-conveying truck in order to make it possible to distribute the quantity of red-hot coke on the load area of the quenching truck. The hot gases which are given off by the coke and are charged with dust rise up in the extractor hood due to their natural buoyancy, with air from the surroundings also being sucked into the extractor hood at the same time. Depending on the size of the particular red-hot coke batches pushed out or on the load-bearing capacity of the gas gallery, of the oven battery, which at least in part bears the coke batch-conveying truck with the hood, it is known to arrange the extracting and purifying device which is connected via a duct to the upper part of the extractor hood, either on the coke batch-conveying truck itself or, as a rule with a greater extracting capacity, in a stationary position at the end of the oven battery. In the latter case a gas-collecting duct is fixed to the oven battery and can be connected in an essentially gas-tight manner to the extractor hood of the coke batch-conveying truck in any operating position of the latter. In this context, it is also known to design the hood on the coke batch-conveying trucks in such a way that it can be lifted and lowered within limits in order to reduce as far as possible the air gap between the lower edge of the extractor hood and the upper edge of the quenching truck and hence to minimize the access of inleaked air. It is also known to equip small hoods for so-called 1-point coke container trucks and for long but coverable quenching trucks with telescopic devices by means of which the hood can be lowered onto the quenching base. For this purpose, however, considerable additional constructional expense is required, and this entails an additional weight load on the gas gallery, which is frequently unacceptable in oven batteries which already exist. Moreover, hoods of this type, which are equipped with lifting devices are more prone to leakages so that this fact must be taken into account by installing a higher extracting capacity for the extracting and purifying device.

On the other hand, quenching trucks are already known which are designed as low-loaders and on which a coke container is fitted for receiving and quenching the red-hot coke. After it has been filled with red-hot coke, the coke container can be closed with a cover and be connected to an extracting and purifying device which is likewise located on the coke container truck and serves to extract and purify the dust-containing gases which are released by the red-hot coke in the coke container. Coke container trucks of this type can receive the red-hot coke without having to be moved during pushing. The extraction duct is connected to the coke container in the upper region of a side wall so that, during filling with red-hot coke when, as a rule, the largest quantities of dust-containing gases are produced, the extraction takes place not by utilizing thermals but against the thermals (The term "thermals" as used here and throughout the specification refers to the previously described phenomenon wherein the hot gases which are charged with dust rise up in the extractor hood due to their natural buoyancy.) In this instance, if the extracting and purifying device on the coke container truck is to be effective, it must possess a very high extraction capacity. In every case, an extractor hood is also necessary here so that the coke container can be covered by a hood joined to the coke batch-conveying truck in order to prevent the gases charged with dust from escaping into the open atmosphere. In this case, however, the hood is not connected to an extracting and purifying device so that the extracting and purifying device, which is connected to the coke container and which is located on the coke container truck, here again must have a high capacity for extracting, against the thermals, the gases which are charged with dust and rise from the red-hot coke in the coke container. Accumulations of heat then develop in the upper part of the hood and these in turn make it necessary to construct the hood from highly heat-resistant material so that the weight of the hood increases and its manufacturing costs are relatively high. The installation of such high extraction capacities on the coke container truck has the result that the latter must have dimensions of up to 50 m in length and have such a large weight that it is hardly possible to maintain the theoretically possible cycle times for operating the oven chambers of an oven battery, taking account of the requisite acceleration and deceleration of the inertia of a coke container truck of this type, even if drives of correspondingly high power for the movement are installed.

Furthermore, when the gases which rise from the red-hot coke and are charged with dust are extracted against their thermals only by the extracting and purifying device located on the quenching truck container, considerably higher demands must be made on the sealing of the hood against the quenching truck or quenching container but, above all, against the coke batch guide because, when the gases charged with dust are extracted against their thermals, the pressure developed in the interior of the extractor hood is of course substantially higher than in the case of an extraction in the upper part of the hood, utilizing the thermals. These high pressures cannot be controlled by mechanical seals, such as are required under the rough conditions in the coking plant. Finally, quenching trucks are known which are covered by flaps in the coke-receiving area where they are not covered by the hood (which hood is relatively short as compared with the length of the quenching truck), the extraction here also being effected only by an extracting device located on the quenching truck, against the thermals in the hood.

It is therefore the object of the invention to improve equipment for receiving and transporting red-hot coke, pushed out of the oven chamber of a chamber coke-oven with vertical flue, and for extracting and purifying the dust-containing gases rising from the coke, in such a way that the thermals of the gases charged with dust and rising from the red-hot coke which has been pushed out are utilized for reducing the extracting and purifying capacity which has to be installed. A tight connection between the coke container and the extractor hood without installation of a lifting device within the extractor hood and hence a reduction in the weight of the hood is possible and nevertheless the advantages can be exploited which result from the use of a coke container which can be closed and by means of which the red-hot coke can be transported to a quenching unit without contaminating the air, while the gases charged with dust and evolved by the red-hot coke in the coke container can be extracted and purified.

The invention achieves this object by a coke batch-conveying truck having an extractor hood, which overhangs the coke container, and by a container truck for the coke, both of which can be driven independently of one another and parallel to the coke-oven. The tilting coke container on the container truck opens upwards but is coverable and it is possible for a single extracting and purifying device, located on the container truck, to be connected, when the open coke container is in the position for receiving coke, in a substantially gas-tight manner exclusively to an extraction duct connected to the top side of the extractor hood and, when the coke container is closed, exclusively to an extraction duct communicating with the interior thereof.

The result achieved in this way is that, when the red-hot coke batch is pushed out of the oven chamber, the gases which rise from the latter and are charged with dust can first be extracted from the top side of the extractor hood, utilizing the thermals or the buoyancy of the hot gases charged with dust, by a single extracting and purifying device installed on the coke container truck while the gases that are released by the red-hot coke present in the coke container and are charged with dust can be extracted and purified by the same extracting and purifying device, after the container has been closed and during its journey to a quenching device. The utilization of the thermals of the gases which rise in the extractor hood and are charged with dust enables the capacity of the extracting and purifying device to be considerably reduced so that important savings in costs and weight and also in the length of the coke container truck are possible. At the same time, this has the substantial advantage that it is possible to dispense entirely with the extracting and purifying device that is normally necessary for extracting the gases which rise in the extractor hood and are charged with dust, in the case of relatively small units on the coke batch-conveying truck and, in the case of relatively large units, of a stationary extracting and purifying device that must be connected in each case to the extractor hood via a collecting duct fixed in position on the oven battery.

In order to make it as simple as possible alternately to connect the extracting and purifying device installed on the coke container truck to the extractor hood or to the coke container located on the coke container truck, it is advisable according to a further development of the invention that, on connecting the extractor hood to the extracting and purifying device, the extraction duct thereof, which can be connected to the coke container, can simultaneously and automatically be closed, while on connecting the coke container to the extracting and purifying device, the extraction duct thereof, which can be connected to the extractor hood, can simultaneously and automatically be closed. In this way the operator effort for the alternating connection of the extracting device to the extractor hood or to the coke container is minimized so that the driver of the coke quenching truck himself can alone carry out all these necessary operating steps.

In detail, it is advisable to provide the extracting and purifying device with a first suction piece which, when the container truck is in the position for receiving coke, can be pressed so as to form a seal against a corresponding extraction piece of the extraction duct which is connected to the top side of the extractor hood and fixed to the coke batch-conveying truck. Moreover, it is advantageous to provide, on the extracting and purifying device, a second suction piece which can be pivoted so as to form a seal against the extraction piece of the extraction duct which is connected to the top side of the coke container.

An essential advantage is obtained by the further measure that the cross-section of the coke-receiving opening of the coke container corresponds, in plan view, to the loading cross-section of the coke container. This makes it possible to admit a quenching fluid, in general water, to the red-hot coke within the coke container across the entire loading cross-section, without heat pockets and, associated therewith, varying quality of coke resulting.

In order to make it possible to obtain a tight connection between the coke container and the extractor hood when the red-hot coke batch is pushed out of an oven chamber, it is also provided that the coke container in the position for receiving coke can be lifted against the lower rim of the extractor hood, so as to form a seal, by means of a lifting device on the coke container truck. This measure is advantageous since the coke container may anyway be equipped with lifting devices for tilting it in order to be able to tip out the quenched coke onto a coke wharf. The extension of these lifting devices, which are necessary for tilting, in the sense of lifting the coke container against the lower edge of the extractor hood thus represents a relatively simple measure as compared with the considerable constructional expense which, by contrast, it is necessary to incur on a lifting device for the extractor hood.

This idea of lifting the coke container against the extractor hood so as to form a seal can with great advantage be developed to include an arrangement of the first suction piece, of the extracting and purifying device, associated with the extraction piece for the hood, and of the coke container on a common lifting device in such a way that a tight connection can be made simultaneously between the coke container and the extractor hood and between the first suction piece of the extracting and purifying device and the extraction piece of the extractor hood. This measure achieves a further advantageous automation of the working procedures on the coke container truck.

It can also be provided that a rigid, distortion-free closing cover for the coke container can be shifted to and fro in the direction of movement of the container truck between a closed and an open position by means of a transport device arranged on the container truck, in the direction in which the latter is driven. This represents an essential measure since a cover of this nature enables the coke container to be sealed substantially completely from the outside within a short time because the closing cover can be transported into the closing position for the coke container by means of the transport device arranged on the container truck immediately after the procedure of pushing out the red-hot coke has ended.

In this arrangement, rails for the closing cover of the coke container, on which rails the closing cover can be driven by means of rollers, are located on a machine and control cabin of the container truck on either longitudinal side thereof parallel to the direction in which the container truck is driven, the closing cover being provided with dogs which are firmly connected to two endless chains, each of which is supported on return and drive wheels on one longitudinal side of the machine cabin and is connected to a drive motor via a reduction gear.

The rigid, distortion-free design of the closing cover makes it possible, according to a further development of the invention, to provide, in the closing cover, a cavity which can be connected via a flexible line to a source of liquid coolant. In this way, a long service life of the closing cover without any distortion thereof due to heat stress is achieved.

Finally, it is advisable to equip the container truck itself with a drive for motion.

Figure 2:
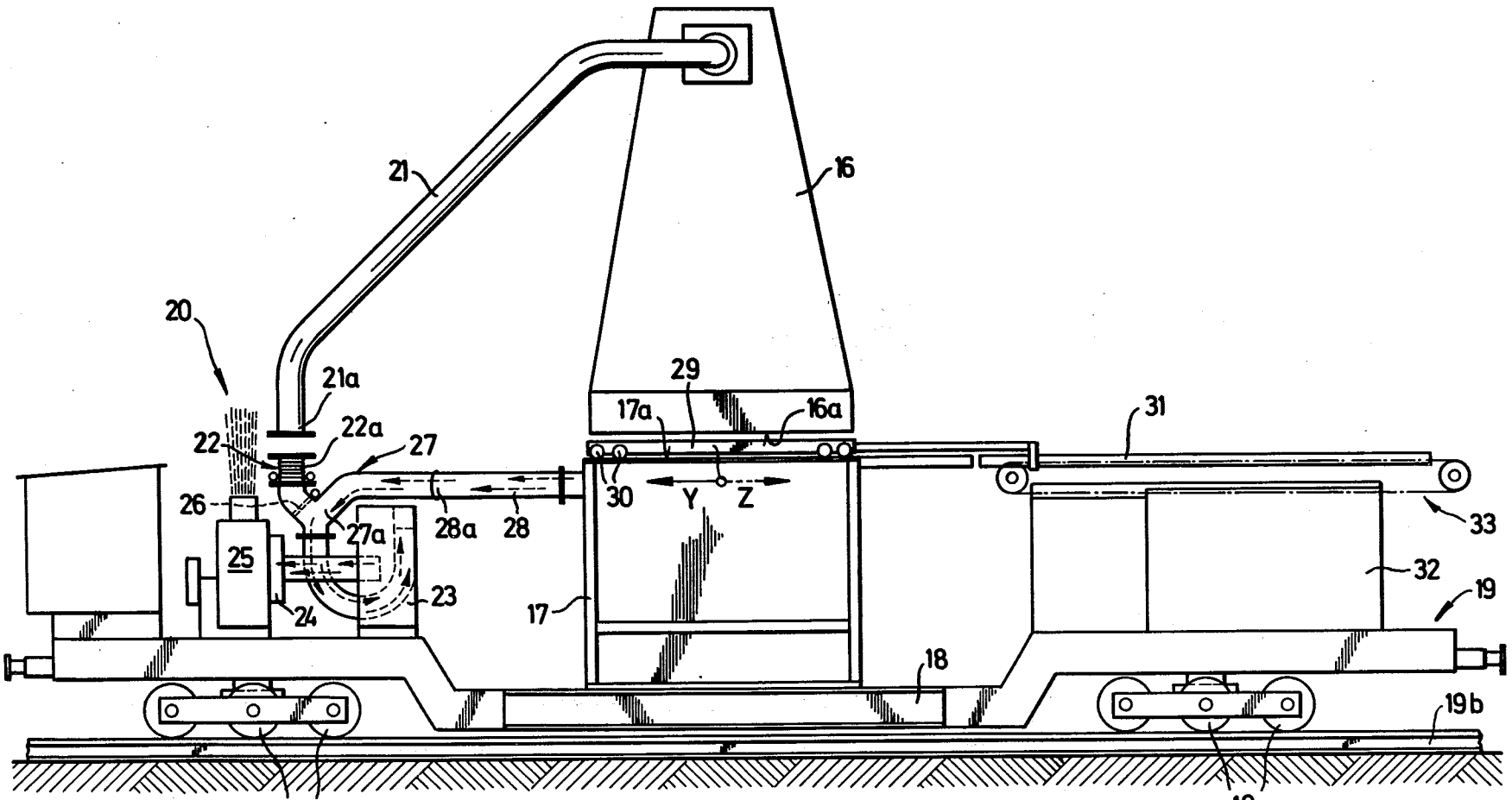
Figure 3A:
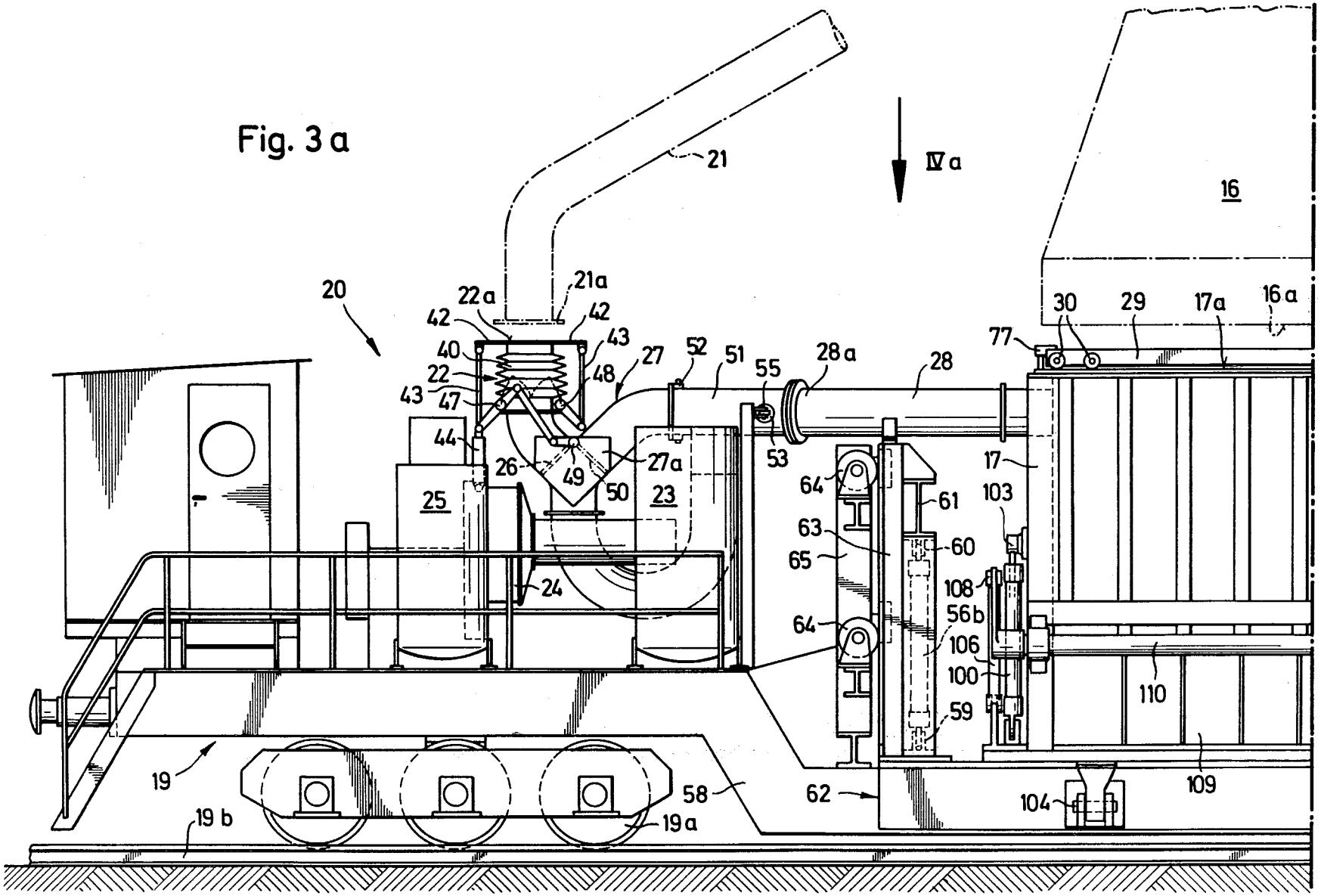
Figure 3B:
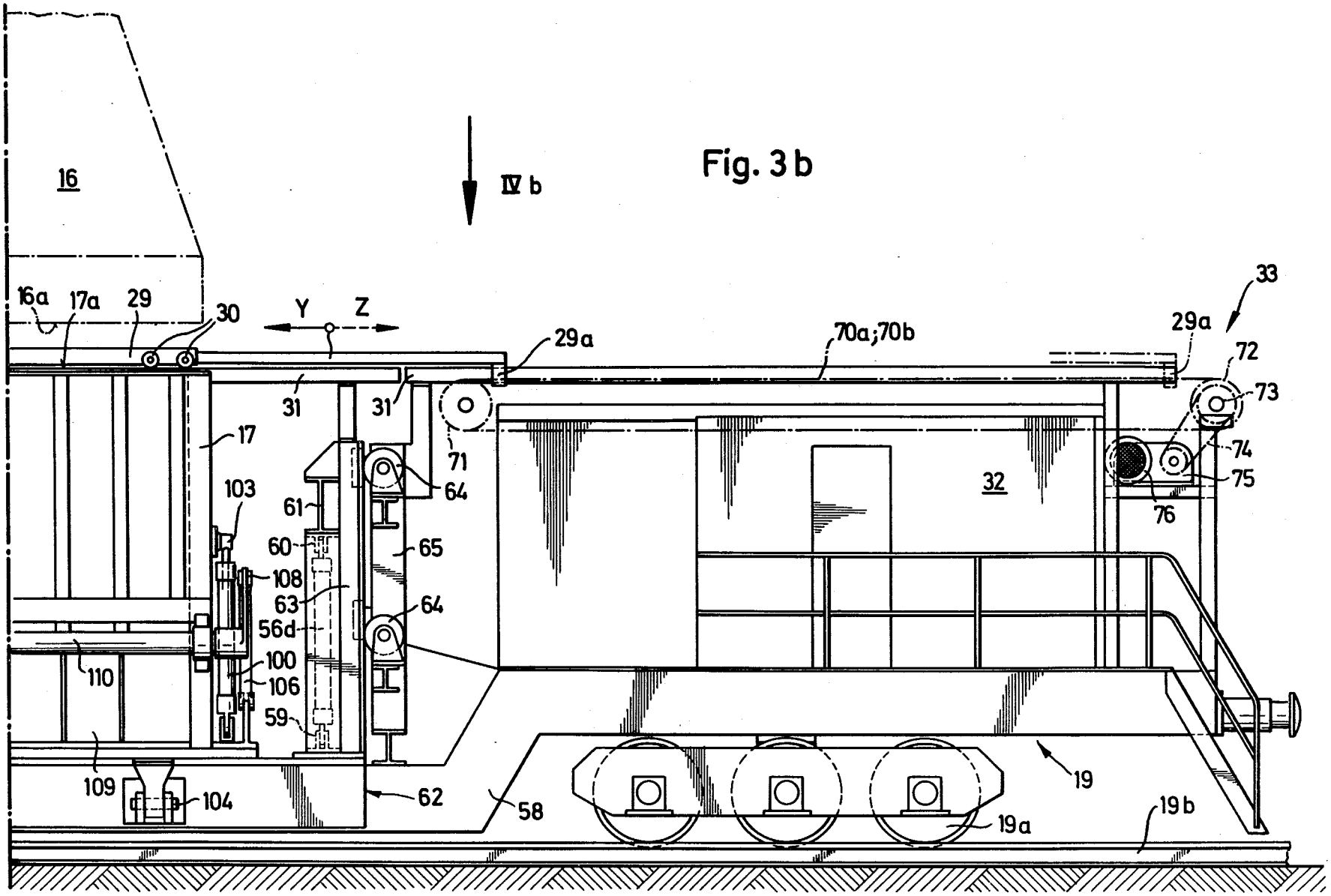
Figure 4A:
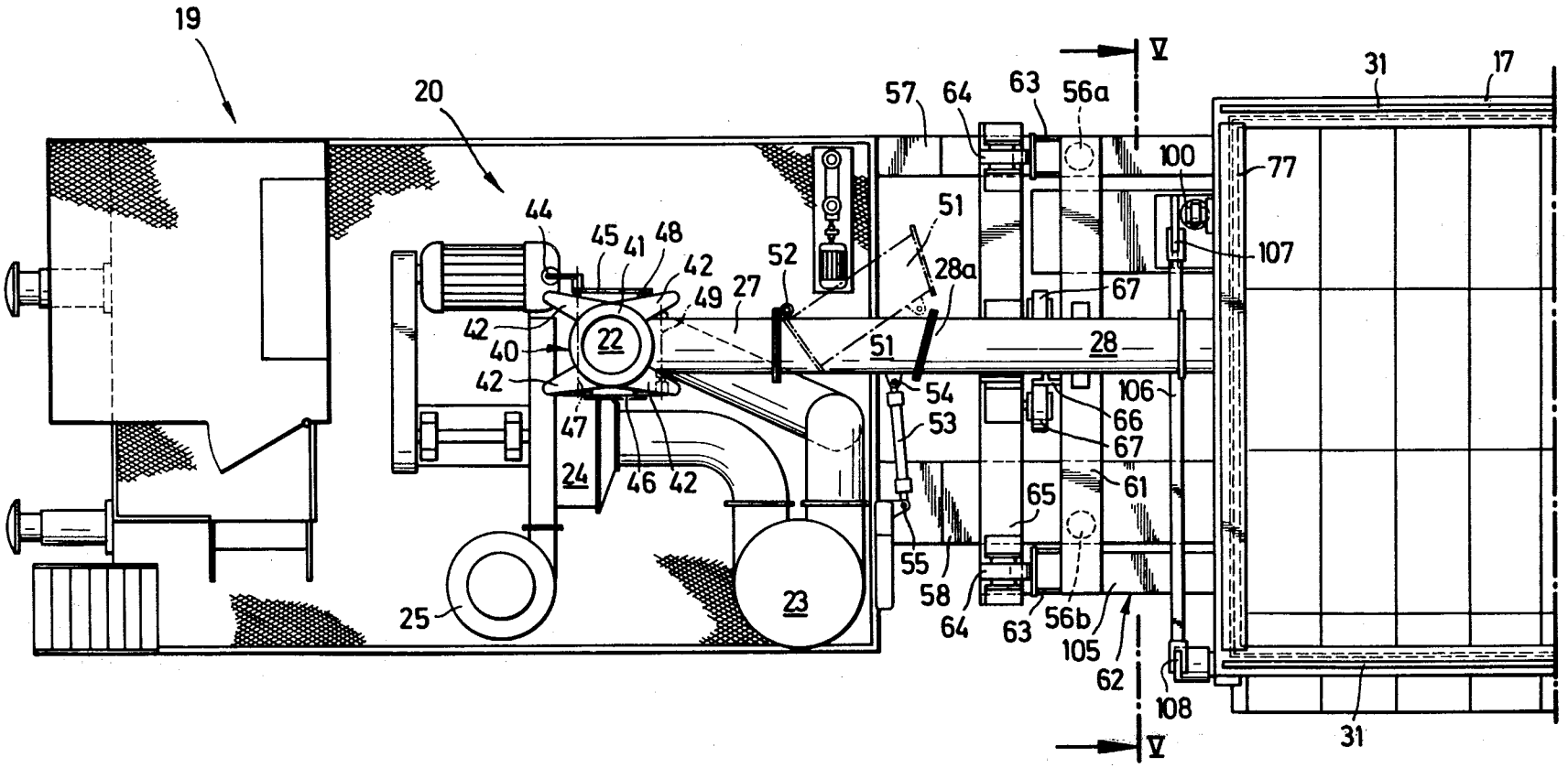
Figure 4B:
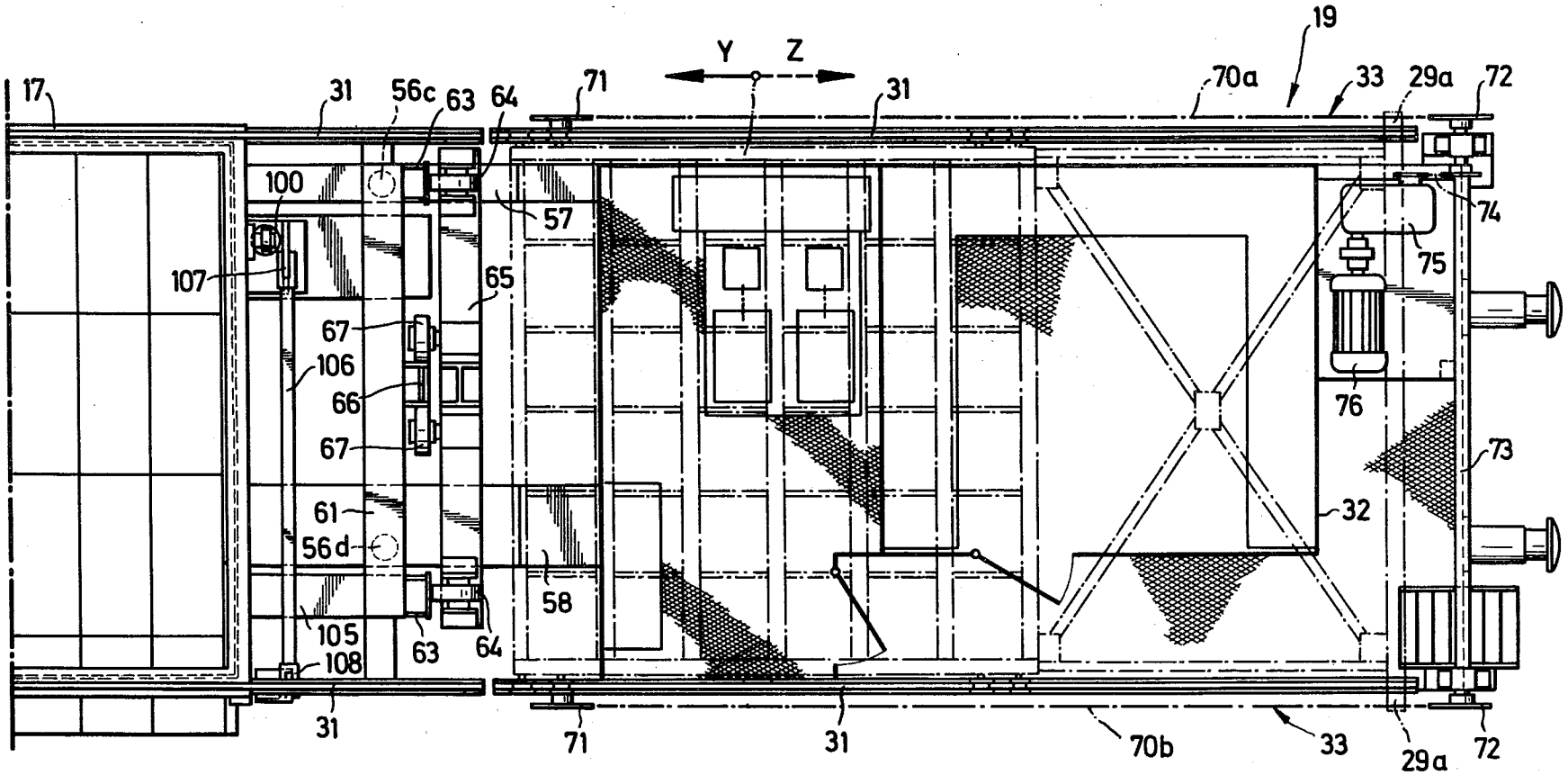
Figure 5:
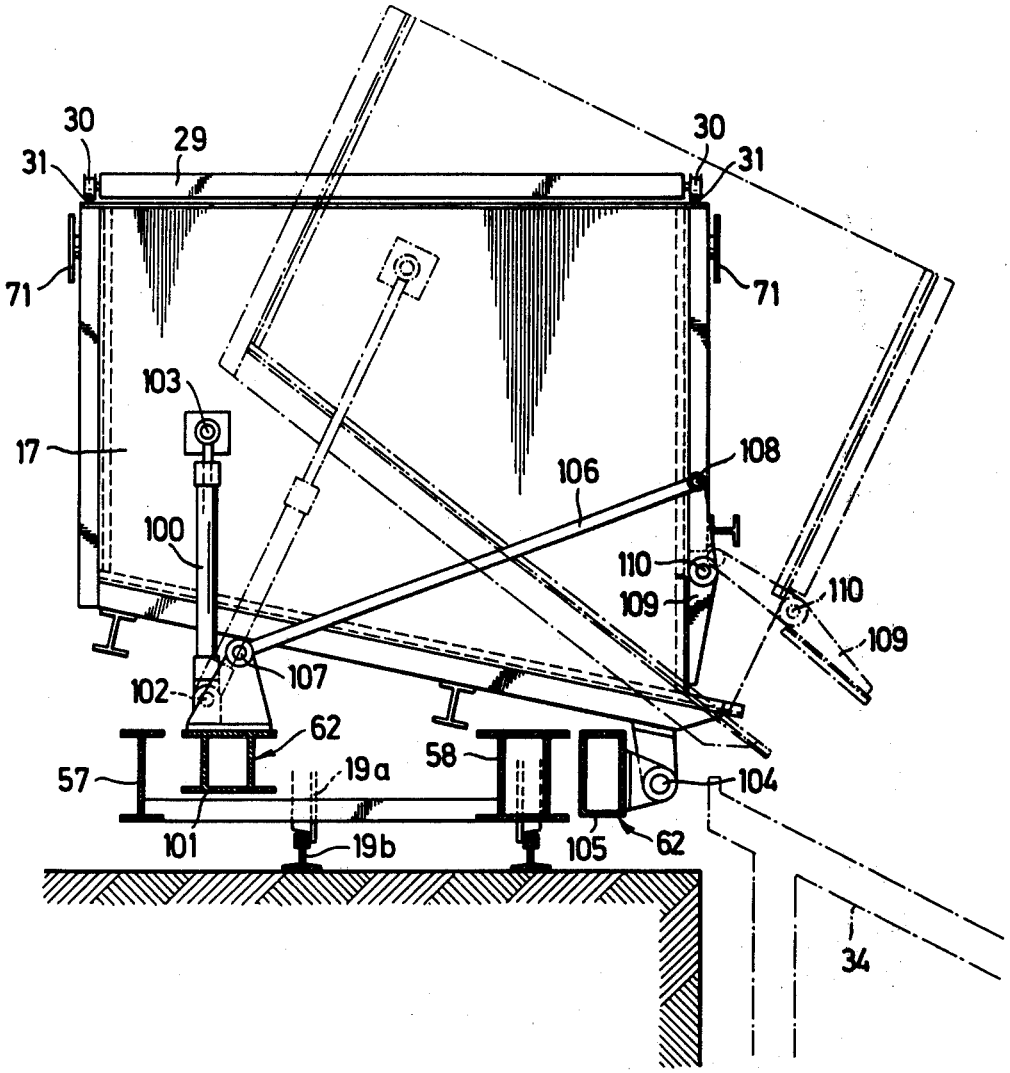

By way of example, the invention is illustrated diagrammatically in the drawing, in which:

FIG. 1 shows equipment for receiving and transporting red-hot coke, pushed out of the oven chamber of a chamber coke-oven with vertical flue, and for extracting and purifying the dust-containing gases rising from the coke, in the position for pushing coke, the coke container having been lifted against an extractor hood, FIG. 2 shows a view of the equipment according to FIG. 1, but after pushing the red-hot coke, the coke container having been lowered and closed by a cover, FIG. 3 (a composite of FIGS. 3*a* and 3*b*) shows the view of FIG. 2 in a more precise representation, FIG. 4 (a composite of FIGS. 4*a* and 4*b*) shows a plan view of the coke container truck in FIG. 3, and FIG. 5 shows a section along the line V—V in FIG. 4, the extraction duct connected to the coke container being omitted.

FIGS. 1 and 2 diagrammatically illustrate the function of the equipment according to the invention. A chamber coke-oven 10 with vertical flue consists of several horizontal oven chambers 11 adjacent to one another and is provided on the coke side with a so-called gas gallery 12, on the tracks of which a coke batch-conveying truck 13 can be driven by means of wheels 14. The coke batch-conveying truck is provided with a coke batch guide 15 which, in a manner which is known and therefore not shown, can be driven tightly against the oven chambers 11 in order to enable a red-hot coke batch to be pushed through the coke batch guide after the doors, which are not shown, of the oven chambers have been opened. An extractor hood 16 covers the top side of the coke batch guide and extends, towards the side facing away from the coke-oven battery, over a coke container 17 which is supported on a lifting device 18 of a container truck 19 and which is constructed as a low-loader and can be driven on a track 19*b* for quenching trucks by means of track wheels 19*a* connected to a drive for motion, which is not shown. In the pushing position for the red-hot coke batch, shown in FIG. 1, the extractor hood 16 overhangs the coke container 17 across the entire cross-section thereof in such a way that the lower edge 16*a* of the extractor hood 16 and the upper edge 17*a* of the opening of the coke container 17, in the position of the latter in which it is lifted by the lifting device 18, are pressed against one another so as to be substantially gas-tight.

On the side which is on the left in the drawing there is an extracting and purifying device which is generally designated as 20 and, in FIG. 1, extracts the hot gases, which flow upwards into the extractor hood 16 and are charged with dust and which rise from the red-hot coke in the coke container 17, utilizing the thermals innate to the rising gases, through an extraction duct 21 the upper end of which bears against the top side of the extractor hood 16 and the extraction piece 21*a* of which bears against a suction piece 22*a* of the extracting and purifying device 20, which suction piece is pressed against the extractor flange 21*a* so as to be substantially gas-tight. The hot gas charged with dust is then sucked through a cyclonic de-duster 23 and from there to an extractor fan 24 which, if appropriate, is designed as a centrifugal spray precipitator and which subsequently feeds the extracted gas to a water separator 25, through the upper opening of which the purified gas issues into the open atmosphere. A flap 26 seals a suction piece 27*a* which, in the lifted position of the coke container 17 shown in FIG. 1, is separated from an extraction duct 28 which is connected to the coke container 17.

A closing cover 29 for the coke container 17 can be driven to and fro by means of rollers 30 on guide rails 31 on either longitudinal side of a machine and control cabin 32 in the direction of motion of the container truck 19 along the arrows Y and Z by means of a transport device which is generally designated as 33. In FIG. 1, the closing cover 29 is, of course, in its open position above the machine cabin 32.

FIG. 2 diagrammatically illustrates the state of the equipment according to the invention after the red-hot coke has been pushed into the coke container 17. It can be seen that the lifting device 18 with the coke container is in its lower position which makes it possible, by means of the transport device 33, to drive the closing cover 29 into the gap between the extractor hood 16 and the coke container 17 and to cover the coke container so that it is substantially gas-tight. The extraction piece 21*a* of the extraction duct 21 connected to the top side of the extractor hood 16 is separated from the suction piece 22*a* of the extracting and purifying device 20, the closure flap 26 in this case sealing the suction piece 22*a* associated with the extraction duct 21 for the extractor hood 16. By contrast, in this lowered position of the coke container 17 in FIG. 2 the suction piece 27*a* is connected in a substantially gas-tight manner to the extraction duct 28 which is joined to the interior of the container a little below the upper rim of the wall facing the extracting and purifying device 20.

In the state shown in FIG. 2, the coke container truck 19 is driven, in a manner which is in itself known, to a quenching tower. The coke container is opened by driving away the closing cover 29, the extracting and purifying device is switched off and the red-hot coke present in the coke container 17 is then quenched. Subsequently the coke is tipped onto a coke wharf 34 shown in FIG. 6. Thereafter a new working cycle for the coke-quenching truck can begin by stopping the latter in front of a further oven chamber, the fully carbonized red-hot coke of which is to be pushed out into the coke container and then to be quenched.

According to FIGS. 3 and 4, the suction piece 22*a* which can be connected to the duct 21 of the extractor hood 16 consists of a bellows 40 made of thin spring steel, and four arms 43 each of the same length are mutually symmetrically arranged starting from the upper ring flange 41, hinged rods two of which are designated as 43 in FIG. 3 being hinged to the underside of the arms. A hydraulic control cylinder 44 actuates lever systems 45, 46 which are located on either side of the suction piece 22*a*, are connected to one another by shafts 47, 48, the lower ends of which are hinged to the hinged rods 43. The lever system 46 is joined to the pivoting axis 49 of the shut-off flap 26 in such a way that, in the lowered position of the suction piece 22*a* of the extracting and purifying device 20, this flap shuts off this suction piece, as shown in FIG. 3, while the shut-off flap is pivoted into the position designated as 50 when the suction piece 22*a* is driven by means of the control cylinder 44 against the extraction piece 21*a* of the extraction duct 21.

The suction piece 27*a* of the extracting and purifying device is provided with a pipe section 51 which, in plan view according to FIG. 4, has a trapezoidal shape and can be pivoted about a vertical axis 52 by means of a control cylinder 53 which is hinged to the pipe section at 54 and to a fixed point of the coke container truck at 55. Corresponding to the operating position in FIG. 3, the pipe section 51 is connected to the extraction duct 28 of the coke container 17 but is pivoted into the position shown by dots and dashes in FIG. 4 when the coke container 17 is to be lifted.

The lifting device for the coke container 17 consists of 4 hydraulic lifting cylinders 56*a*, 56*b*, 56*c* and 56*d* which are pivotally supported at 59 in pairs on longitudinal beams 57 or 58 and their piston rods engage at 60, likewise pivotally, with the underside of transverse beams 61 of a lifting structure 62. Four vertical guide columns 63 of the lifting structure are supported against both directions of motion and guided on guide rollers 64 which are located vertically one above the other at a distance and are mounted in a pair of guide structures 65 fixed on the coke container truck, while the vertical guide which is secured laterally is provided with a guide profile 66 which extends vertically along the two opposite front faces of the lifting structure and on which pairs of rollers 67 roll along on each of the opposite sides, the pairs of rollers in turn being mounted in the guide structure 65 which is fixed to the longitudinal beams of the coke container truck. It will be understood that the coke container 17 can be lifted in this way by means of the lifting structure 62 into the upper position in which it is connected so as to form a seal to the extractor hood 16, so that the entire free loading cross-section of the coke container, which can be seen in FIG. 4, is covered exactly by the extractor hood 16.

Deviating from the embodiment represented in FIGS. 3 and 4, it is, of course, possible to extend the lifting structure towards that side on which the extracting and purifying device 20 is located in such a way that the lifting device not only lifts the coke container 17 against the extractor hood 16 but simultaneously lifts the suction piece 22*a* against the extraction piece 21*a* of the extraction duct 21.

The closing cover 29 is designed to be rigid and distortion-free and can be driven, by means of its rollers 30 on its two longitudinal sides, on the pair of rails 31 which is fixed on the two longitudinal sides of the machine and control cabin 32 on the top side thereof, parallel to the direction of motion YZ. On its side facing away from the extracting and purifying device, the closing cover 29 is provided with dogs 29*a* which are firmly connected to two endless chains 70*a*, 70*b*, each of which is supported on a pair of return and drive sprockets 71, 72 on one longitudinal side of the machine cabin 32, the drive sprockets 72 being connected to one another by a shaft 73 which is connected via a further chain drive 74 to a reduction gear 75 which can be coupled to a drive motor 76. The gear can at the same time be designed as a gear which changes the direction of drive, or it is possible to choose a drive motor in which the direction of drive can be switched over. On the side facing the extracting and purifying device 20 the coke container 17 is provided with a stop bar 77 for the closing cover 29, which stop bar is optionally equipped at the same time with a limit switch, by means of which the drive motor 76 or an electromagnetic coupling between the motor and the gear 75 is automatically switched off.

The tilting device, which is in itself known, for the coke container 17 in FIG. 5 consists of a lifting cylinder 100 which is hinged at 102 to a beam 101, of the lifting structure 62, facing the oven battery and parallel thereto and the upper end of which is hinged to a projection 103 on the two front faces of the coke container. The coke container 17 is mounted so that it can pivot about pivoting axes 104 on that side of a beam 105 which faces away from the oven battery.

In the vicinity of the hinge point 102 for the lifting cylinder, a hinged rod 106 is pivotally mounted at 107, the other end of which is hinged at 108 to the upper end of a discharge flap 109 which can be pivoted about an axis 110 in such a way that, when the coke container is lifted into the discharge position shown by dashes and dots in FIG. 5, the discharge flap 109 automatically assumes the open position which can be seen from FIG. 5. Consequently, after the coke has been quenched, this can be tipped out onto the loading wharf 34.

If desired, the closing cover 29 of the coke container can be provided with a fitting for connection to a source of liquid coolant.

It is, of course, intended to cover by the appended claims all such modifications that fall within the true spirit and scope of the invention.

What is claimed is:

1. Equipment for receiving and transporting red-hot coke from an oven chamber of a coke oven and for extracting and purifying the dust-containing gases rising from the coke comprising an upwardly open coke container and a coke container truck supporting same, a coke batch-conveying truck having an overhanging extractor hood, the interior of said coke batch-conveying truck communicating with the interior of said extractor hood, means for driving each of said coke container truck and coke batch-conveying truck parallel to the coke oven and relative to each other, means for temporarily sealingly engaging said coke container with said overhanging extractor hood, cover means disposed adjacent to and out of contact with said coke container and means for moving said cover means to cover said coke container when the coke container is moved out of sealing engagement with said extractor hood, extracting and purifying means located on the container truck for extracting and purifying dust-containing gases, and conduit means for connecting said extracting and purifying means alternately between (1) the interior of the uppermost portion of the extractor hood when the hood is in sealing engagement with said coke container on said container truck to permit extracting and purifying dust-containing gases therefrom and (2) the interior of the uppermost portion of the coke container on said container truck when said coke container is moved out of sealing engagement with said extractor hood and is covered with said cover means, said conduit means including (a) first and second duct means for receiving said gases from said extractor hood and from said coke container, respectively, and (b) means for (1) closing off flow to said extracting and purifying means through said second duct means and leaving the first duct means open when the extractor hood is in sealing engagement with said coke container and (2) closing off flow to said extracting and purifying means through said first duct means and opening said second duct means when the coke container is moved out of sealing engagement with said extractor hood and is covered with said cover means.

2. Equipment in accordance with claim 1 in which said first duct means includes a first extraction duct connected to said extractor hood, a movable first suction section, and means for moving said first suction section into sealing engagement with said first extraction duct to connect said extractor hood to said extracting and purifying means.

3. Equipment in accordance with claim 1 in which said second duct means includes a second extraction duct connected to said coke container, a second suction section, and means for moving said second suction section into sealing engagement with said second extraction duct to connect said coke container to said extracting and purifying means.

4. Equipment according to claim 1 in which said cover means includes a cover for being moved into and out of covering engagement with said coke container.

5. Equipment according to claim 1 including means on said coke container truck for moving said coke container into and out of sealing engagement with said extractor hood.

6. Equipment in accordance with claim 5 in which said coke container moving means includes lifting means for alternately elevating said coke container into sealing engagement with said extractor hood and tilting said coke container to discharge coke therefrom.

* * * * *